United States Patent [19]

Kays

[11] 3,980,199

[45] Sept. 14, 1976

[54] GAS VENTING FOR FLOATING COVER

[75] Inventor: William B. Kays, La Habra, Calif.

[73] Assignee: Globe Linings, Inc., Long Beach, Calif.

[22] Filed: Aug. 16, 1974

[21] Appl. No.: 498,223

[52] U.S. Cl. ..... 220/227; 220/368

[51] Int. Cl.[2] ..... B65D 51/16

[58] Field of Search ..... 220/227, 218, 216, 219, 220/368; 137/430, 433, 202

[56] References Cited

UNITED STATES PATENTS

| | | | |
|---|---|---|---|
| 1,513,043 | 10/1924 | Huff | 220/227 |
| 1,777,560 | 10/1930 | Griffin | 220/227 |
| 2,007,193 | 7/1935 | Griffin | 220/227 |
| 2,601,317 | 6/1952 | Moyer | 220/227 |
| 2,867,347 | 1/1959 | Champagnat | 220/227 |
| 3,474,931 | 10/1969 | Daniels et al. | 220/219 |
| 3,667,641 | 6/1972 | Dial | 220/219 |

FOREIGN PATENTS OR APPLICATIONS

| | | | |
|---|---|---|---|
| 1,050,142 | 1/1954 | France | 220/227 |

*Primary Examiner*—George E. Lowrance
*Assistant Examiner*—Joseph M. Moy
*Attorney, Agent, or Firm*—Fulwider, Patton, Rieber, Lee & Utecht

[57] ABSTRACT

A gas venting system for a liquid storage reservoir having a floating cover comprising a sheet of flexible material lying upon the liquid and attached to the reservoir sides. Elongated blocks of flotation material are attached to the underside of the cover and buoy the cover in such a way that the edge margins of the blocks and the adjacent portions of the cover define downwardly open collection spaces. A gas collection manifold in communication with these collection spaces receives and carries away gases collecting in the collection spaces. In one embodiment the flotation blocks include transverse conduits affording communication between the collection spaces on opposite sides of the blocks, with the transverse conduits being in communication with the gas collection manifold. In another embodiment the gas collection manifold includes perimeter conduits extending along at least one side of the reservoir, with certain of the elongated blocks extending up to these perimeter conduits to provide communication between the collection spaces and the perimeter conduits.

7 Claims, 7 Drawing Figures

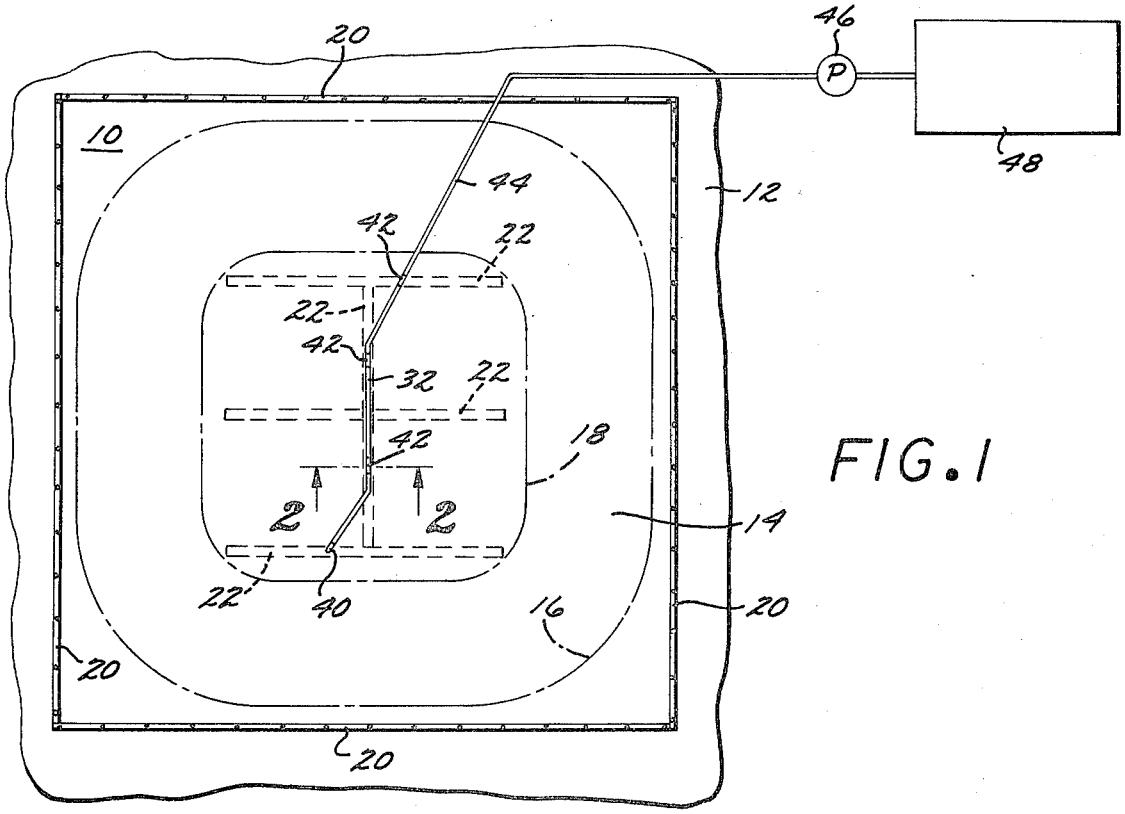
FIG. 1
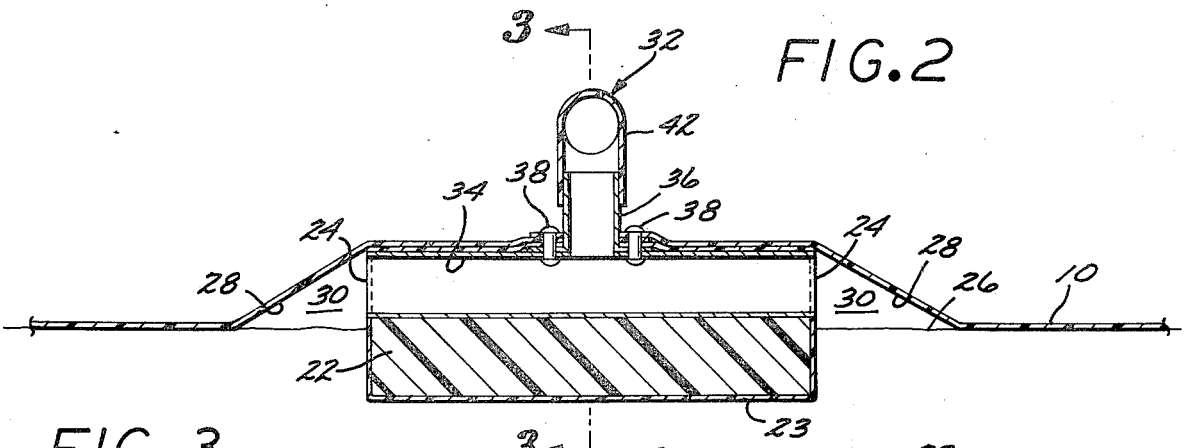
FIG. 2
FIG. 3
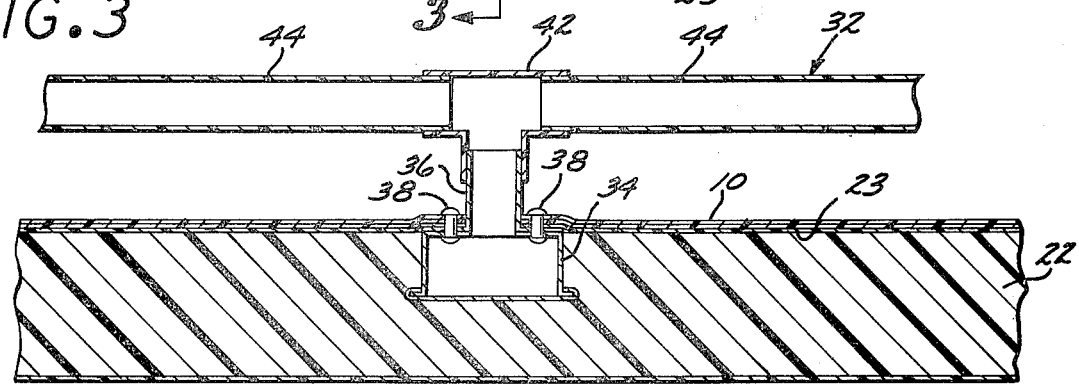

FIG. 4
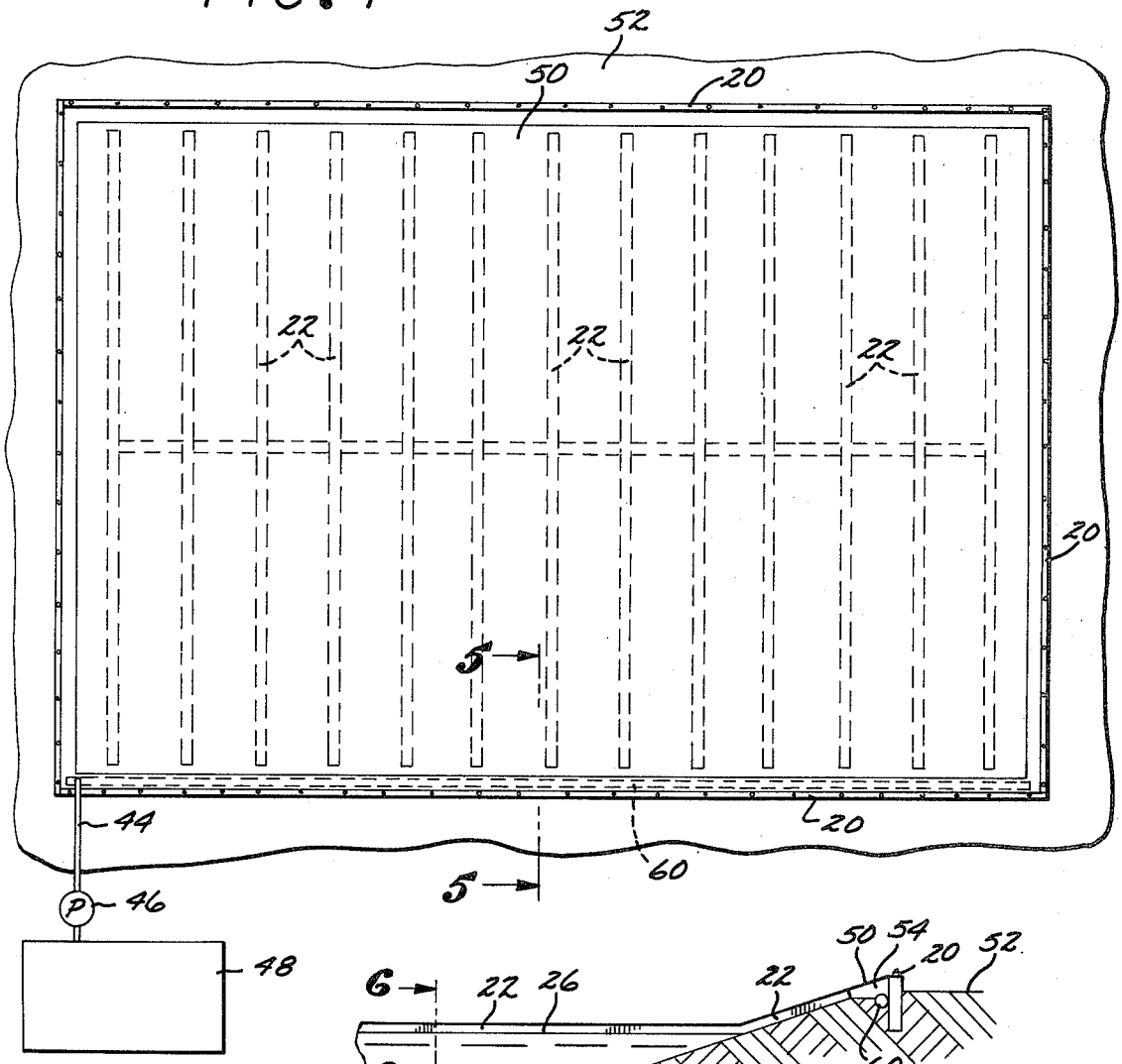
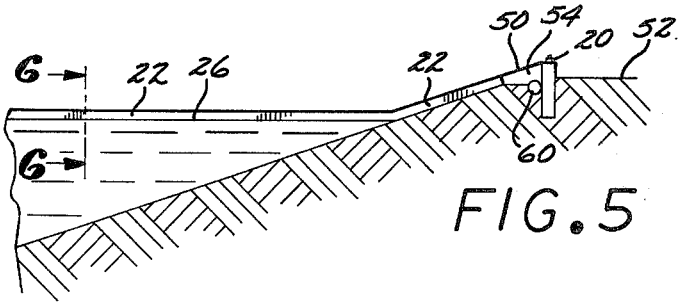
FIG. 5
FIG. 6
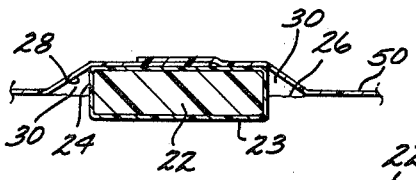
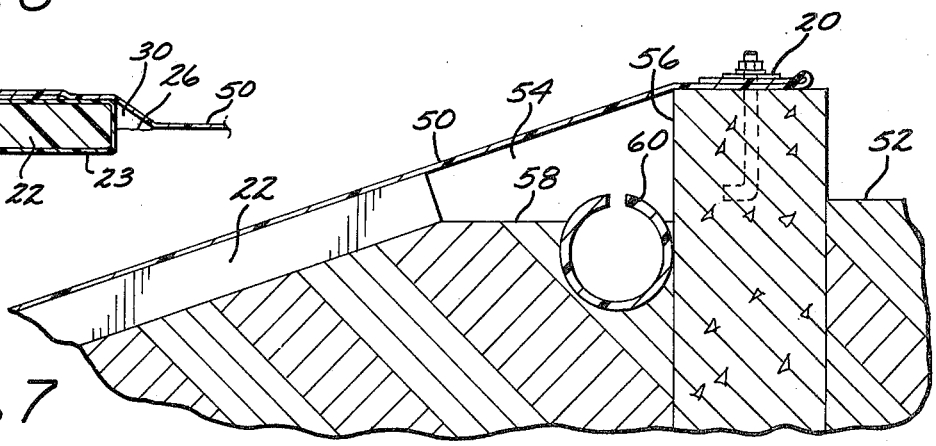
FIG. 7

GAS VENTING FOR FLOATING COVER

BACKGROUND OF THE INVENTION

1. Field of the Invention:

The present invention relates to a floating cover, having a gas venting system, for receiving and carrying away gases collecting beneath a floating cover for a liquid storage reservoir.

2. Description of the Prior Art:

Noxious and unpleasant gases are generated by many stored liquids, such as sewage and the like in sewage treatment lagoons or reservoirs. Some facilities of this type are open to the atmosphere and the released gases constitute a nuisance to the surrounding community. Other facilities of this type are provided with rigid covers which completely contain the escaping gass so that collection and removal of the escaping gases is relatively easy. The gases collect below the roof dome and are pumped off for suitable disposition. Floating covers for such facilities are becoming more widely used because they are able to prevent the escape of such gases and yet are considerably less expensive than rigid covers.

By floating cover is meant a cover made of relatively thin, flexible sheet material which lies upon the surface of liquid stored in a reservoir or the like. A cover of this general type wherein provision is made for permitting formation of depending folds in the sheet which serve as collection sumps for rain water and the like is described in U.S. Letters Pat. No. 3,313,443, issued Apr. 11, 1967, and entitled "Floating Cover for a Liquid Storage Reservoir". The edges of such a cover are attached to the reservoir sides or perimeter sufficiently tightly that gases emanating from the reservoir liquid cannot escape but instead collect underneath the cover. Such gases must be carried off or they will cause the cover to inflate or balloon up to an elevation where the cover will be subjected to possible high wind loads, overstressing, and eventual structural failure.

The problem of properly venting floating roof covers is not confined to sewage treatment lagoons, ponds, or reservoirs, but also often exists in other types of reservoirs. For example, the water coming into a fresh water storage reservoir often contains enough dissolved air or other gases that there is continuous gas evolution. In fact, some fresh water storage facilities provide for the bubbling of air through the stored water to aerate it.

In any event, and regardless of the nature of the stored liquid, the disposal of gases from beneath a floating cover is complicated by the fact that the cover rest on top of the liquid and the gases tend to collect in random pockets, frustrating attempts to effect systematic removal. Installation of vents and the like is impractical where the gas collection areas cannot be predetermined.

SUMMARY OF THE INVENTION

According to the present invention, a gas venting system is provided in a floating cover for a liquid storage reservoir, the cover being of that type comprising a continuous sheet of flexible material lying upon the liquid in coextensive relationship therewith and attached to the reservoir sides. The venting system comprises a combination of elongated blocks of flotation material and a gas collection manifold. The blocks are attached to the underside of the cover and buoy those portions of the cover adjacent the edge margins of the blocks above the surface of the liquid in such a manner that the edge margins and the adjacent portions the cover define downwardly open collection spaces. The gas collection manifold includes means providing communication between such collection spaces so that gases accumulating in the spaces are received and carried away.

In one embodiment opposite sides of certain of the flotation blocks are in communication through transverse conduits embedded in the blocks. These transverse conduits are in communication with the gas collection manifold.

In another embodiment the gas collection manifold includes perimeter conduits extending along at least one side of the reservoir, with the collection spaces in communication with such perimeter conduits. In both embodiments the flotation means for the cover are organized and arranged to define interconnected collection spaces which, in combination with the gas collection manifold, effect the desired collection and removal of gases accumulated beneath the cover. The system of floats predetermines the areas of gas collection whereby the gas may be conveniently tapped off and removed.

Other objects and features of the invention will become apparent from consideration of the following description taken in connection with the accompanying drawings.

BRIEF DESCRIPTION OF THE DRAWINGS

FIG. 1 is a top plan view of a floating cover installed upon a liquid storage reservoir and incorporating the gas venting system of the present invention;

FIG. 2 is an enlarged view taken along the line 2—2 of FIG. 1;

FIG. 3 is a view taken along the line 3—3 of FIG. 2;

FIG. 4 is a top plan view of a second embodiment of the present invention, forming a part of the floating cover installed upon a liquid reservoir;

FIG. 5 is an enlarged view taken along the line 5—5 of FIG. 4;

FIG. 6 is an enlarged view taken along the line 6—6 of FIG. 5; and

FIG. 7 is an enlarged view of a portion of FIG. 5, illustrating one of the perimeter conduits and adjacent structure.

DESCRIPTION OF THE PREFERRED EMBODIMENTS

Referring now to the drawings, and particularly to FIGS. 1 through 3, there is illustrated a floating cover designated generally by the numeral 10 and illustrated in association with an earthen reservoir 12 of generally square shape, although the invention is equally applicable to other shapes such as circular, rectangular and the like. The particular reservoir 12 is characterized by downwardly and inwardly slanting or sloping sidewalls 14, forming a bowl-like configuration. The top or upper edge of the slope is indicated by the numeral 16 in FIG. 1, while the bottom or toe of the slope is indicated by the numeral 18. In the particular embodiment illustrated, the portion of the flexible cover between the top 16 and the toe 18 of the slope is unsupported by any flotation material other than that of the cover itself. As will be seen, flotation material is provided for the cover within the area bounded by the toe 18.

The cover 10 is a continuous sheet of flexible, relatively thin material such as butyl rubber sheeting, or vinyl, polyethylene Hypalon, Neoprene chlorinated polyethylene (CPE), or similar film, which is impervious to and adapted to completely overlie the liquid in the reservoir 12. The cover is coextensive with and lies upon the liquid, and is preferably fabric reinforced for improved tear strength.

Assuming the reservoir 12 is one in which it is important to contain gases evolved from the contained liquid, the peripheral or free edges of the cover 10 are attached in fluid-tight relationship to the upper part of the reservoir by a peripherally continuous sheet anchor 20. Any suitable anchor 20 for this purpose may be used. The general showing of the anchor 20 in FIG. 1 is simply a plurality of aluminum straps arranged in end abutting relation about the periphery of the reservoir and clamping the cover edges to the reservoir. Suitable bolts or studs pass downwardly through the straps, through the cover, and into the reservoir structure.

The cover 10 is floated or buoyed upon the surface of the stored liquid by a plurality of float units or elongated flotation blocks 22. Each flotation block 22 is made of a buoyant material such as one of the well know plastic or foam materials of the closed cell type. Each flotation block 22 is encased by an outer casing or sleeve 23 made of flexible sheet material, which preferably is of the same material as the cover 10 or compatible therewith adhered to the underside of the cover 10 by any suitable adhesive.

The elongated blocks 22 are arranged in end abutting relation in lines or strings in the pattern illustrated in FIG. 1. The pattern is merely exemplary and comprises a longitudinal or central string of blocks adhered to the underside of the cover, and terminating just inside the slope toe 18, and three transverse or lateral strings of blocks, one across each end of the middle of the longitudinal string. The outer ends of the lateral strings of blocks also terminate just inside the slope toe 18.

As best viewed in FIG. 2, each flotation block 22 is characterized by generally vertically oriented edge margins 24 on opposite sides therof. Since each flotation block 22 is buoyed upwardly out of the stored liquid, whose level is indicated at 26, the edge margins 24 and the adjacent portions 28 of the cover define generally triangular, downwarly open collection spaces 30 for receiving and carrying away gases evolving upwardly from the stored liquid.

In the particular embodiment illustrated in FIGS. 1 through 3, the cover 10 is characterized by an area that is greater than the area of the reservoir periphery to which the cover 10 is attached by the sheet anchor 20. The excess material allows the cover to rise and fall as the liquid level in the reservoir changes. However, the orientation and arrangement of the strings of flotation blocks 22 is unchanged during movement of the liquid level up and down.

Four of the flotation blocks 22 are provided with elongated, transversely disposed conduits 34 to provide communication between the collection spaces 30 on opposite sides of the blocks. As best seen in FIGS. 2 and 3, each conduit 34 can be of any suitable cross-section, e.g., as shown the conduit is of rectangular cross-section and is embedded in a cut-out section of the associated block 22. The conduit 34 extends across the width of the block 22 and is preferably made of stainless steel or the like to resist corrosion.

The base flange of a vertically extending riser or stub pipe 36 is positioned over suitable openings provided in the block sleeve 23 and in the upper wall of each conduit 34 to provide communication between the pipe 36 and the interior of the conduit 34.

The cover 10 is made up of sections of material which are adhered together by lap joints, one of which occurs along the length of the strips of flotation blocks 22. Each stub pipe 36 extends upwardly through suitable openings in the overlapped portions of the cover, and a plurality of rivets 38 or similar fasteners are disposed through the cover, the base flange of the pipe 36, and the upper wall of the conduit 34 to hold these components together.

Since the spaces 30 along the length of each string of blocks 22 are in communication, the gases in such spaces flow toward the conduits 34. Each conduit 34 provides a common path for the gases in the spaces 30 on opposite sides of the blocks 22 to pass upwardly through the adjacent stub pipe 36. Although the four conduits 34 could be located at various places in the strings of blocks 22, the locations illustrated are preferred for the block pattern shown.

An elbow fitting, generally indicated at 40 in FIG. 1, is fitted onto the stub pipe 36 for the lowermost lateral string of blocks 22, and T-fittings 42 are fitted onto the remaining three conduits 34, as best seen in FIGS. 2 and 3. Sections of a connecting pipe 44 are connected in communication with the fittings 40 and 42. The upper end of pipe 44 is attached in any suitable fashion to the reservoir periphery. From that point the pipe 44 extends to a conventional pump 46 which is operative to pump gases from the pipe 44 into a collector tank, scrubber, burner, or other apparatus 48 for treating or disposing of the collected gases.

The various pipes and conduits are preferably made of corrosion resistant material such as stainless steel or plastic material. The pipe 44 also preferably includes a flexible portion (not shown) to accommodate vertical movement of the cover 10 as the reservoir liquid level changes.

With the foregoing arrangement gases evolving from the liquid 26 pass upwardly and tend to collect in the spaces 30. Since the blocks 22 are arranged in end-abutting relation, the gases next pass along the lengths of the strings of blocks 22 until the conduits 34 are reached. Here the gases enter the conduits 34 and pass upwardly through the stub pipes 36 and into the pipe 44. Although in some instances a pump may not be necessary, operation of the pump 46 facilitates movement of the gases into the disposal apparatus 48.

The collection of gases is thus automatic and is made to occur at the spaces 30 where provision can be made for the systematic venting of the gases. The number of strings of blocks 22 can be varied as needed to provide adequate spaces 30 for the rate of gas evolution from the reservoir. Random collection of gas will thus not occur since any appreciable accumulation of gases tends to migrate toward the collection spaces 30.

Referring now to FIGS. 4 through 7, another embodiment of the present invention is illustrated. The cover 50 illustrated is generally rectangular and arranged in coextensive relationship with a generally rectangular reservoir 52. The material of the cover 50 is like that of the cover 10. Its edges are attached to the reservoir sides by a sheet anchor 20, and a plurality of flotation blocks 22 are attached to the underside of the cover 50. The blocks 22 are arranged in end-abutting relation in a pattern of parallel, uniformly spaced apart rows of strings.

The strings of blocks 22 extend across the width of the cover 50 and terminate just short of the reservoir periphery. The string of blocks 22 are sufficiently long that when the level of liquid 26 drops below the maximum level, the end ones of the blocks 22 rest upon the sloping walls of the reservoir, as seen in FIG. 5. However, the material of the blocks 22 is sufficiently flexible or the blocks can be formed as joined segments so that the consequent bending of the strings does not result in structural damage.

As in the case of the first embodiment, the block edge margins 24 define collection spaces 30 with the adjacent edge margins 24 of the cover 50. These collection spaces 30 allow evolved gases to pass along the length of the end-abutting blocks 22 of each string to perimeter conduits 54 defined by the bounding four walls 56 of the reservoir perimeter, the adjacent horizontal reservoir surface 58, and the underside of the cover 50. If desired, a slotted metal conduit 60 can be embedded in the reservoir structure along one side, as seen in FIG. 7. The conduit 60 also forms a part of the perimeter conduit system and collects gases from the conduits 54. Alternatively, a short conduit can be placed in wall 56 communicating with conduits 54.

As seen in FIG. 4, the gases are drawn out of the perimeter conduit 60 by the pump 46 for passage into the treatment apparatus 48.

Thus, the roof cover 50 of FIGS. 4 through 7 is generally similar in construction to that of FIGS. 1 through 3, except that the collection spaces 30 of the cover 50 constitute the sole means for the passage of gases to the perimeter conduits 54 and 60.

Both embodiments of the present invention provide predetermined areas of accumulation for the evolved gases so that such gases can be easily collected and drawn off for suitable disposition.

Various modifications and changes may be made with regard to the foregoing detailed description without departing from the spirit of the invention.

I claim:

1. A floating cover for a liquid storage reservoir, said cover comprising:

a continuous sheet of flexible material lying upon the liquid in the reservoir in coextensive relationship therewith and attached to the reservoir sides;

elongated blocks of flotation material attached to the underside of said cover and buoying the portions of said cover adjacent the edge margins of said blocks above the surface of said liquid, said cover extending downwardly from said edge margins into contact with the liquid surface in a natural drape by reason of the flexibility of the material of said cover whereby said edge margins and said portions of said cover define downwardly open collection spaces located above the surface of said liquid; and a gas collection manifold having means providing normally open communication between said collection spaces for receiving and carrying away gases collecting in said collection spaces.

2. A cover according to claim 1 wherein certain of said blocks include transverse conduits providing communication between said collection spaces on opposite sides of said certain of said blocks.

3. A cover according to claim 2 wherein said manifold is in communication with said transverse conduits.

4. A cover according to claim 1 wherein certain of said blocks include transverse conduits providing communication between said collection spaces on opposite sides of said certain of said blocks, and said manifold includes stub pipes in communication with each of said transverse conduits, and further includes a connecting pipe above said cover in communication with said stub pipes and extending onto the periphery of the reservoir.

5. A cover according to claim 4 wherein said blocks are spaced inwardly of said reservoir periphery to define an unsupported area of said cover, said connecting pipe extending across said unsupported area and onto the periphery of the reservoir being flexible to accommodate rising and falling of said cover as the liquid level in the reservoir changes.

6. The improvement according to claim 1 wherein said gas collection manifold includes perimeter conduits extending along at least one side of said reservoir, and wherein said collection spaces are in communication with said perimeter conduits.

7. The improvement according to claim 6 wherein certain of said elongated blocks extend up to said perimeter conduits to effect said communication between said collection spaces and said perimeter conduits.

* * * * *